US005800694A

United States Patent [19]

Starcevic et al.

[11] Patent Number: 5,800,694

[45] Date of Patent: *Sep. 1, 1998

[54] PROCESS AND PLANT FOR PICKLING MATERIALS MADE OF STEEL, IN PARTICULAR STAINLESS STEEL

[75] Inventors: Jovan Starcevic, Vienna; Erich Mahr, Porkersdorf, both of Austria

[73] Assignee: Andritz-Patentverwaltungs-Gesellschaft m.b.H., Graz, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 601,723

[22] Filed: Feb. 15, 1996

[30] Foreign Application Priority Data

Feb. 15, 1995 [AT] Austria ..... 267/95

[51] Int. Cl.[6] ..... C25F 1/00

[52] U.S. Cl. ..... 205/705; 205/712; 205/714; 204/206; 204/207; 204/208

[58] Field of Search ..... 205/705, 712, 205/714; 204/206, 207, 208

[56] References Cited

U.S. PATENT DOCUMENTS

| | | | |
|---|---|---|---|
| 4,129,485 | 12/1978 | Shikata et al. | 205/712 |
| 4,450,058 | 5/1984 | Lovejoy | 205/714 |
| 4,851,092 | 7/1989 | Maresch | 205/714 |

*Primary Examiner*—Arun S. Phasge
*Attorney, Agent, or Firm*—Alix, Yale & Ristas, LLP

[57] ABSTRACT

The invention concerns a process for pickling material strips made of steel, in particular stainless steel, where the strip passes through at last one pickling bath with at least one pickling acid. It is above all characterized by the fact that the acid concentration and/or the acid composition is controlled as a function of the material quality, of the pre-treatment and of the operating parameters of the pickling plant. Furthermore, the invention concerns a plant for carrying out the process, where at least two circulation tanks having different acid concentrations and/or acid compositions are provided.

22 Claims, 2 Drawing Sheets

PROCESS AND PLANT FOR PICKLING MATERIALS MADE OF STEEL, IN PARTICULAR STAINLESS STEEL

BACKGROUND OF THE INVENTION

This invention relates generally to a process for pickling materials made of steel. More particularly, the present invention relates to a process for pickling materials made of stainless steel, where the strip passes through at least one pickling bath containing at least one pickling acid. It also concerns a plant for carrying out the process.

When producing flat steel products from stainless steel, a layer of scale is normally produced on the surface of the steel strip. This scale layer is removed by pickling. Mixed acid (hydrofluoric acid and nitric acid) is normally used as the pickling medium. Using mixed acid in the pickling operation causes great problems in most plants because of sludge formation. Since adaptation of the pickling systems to the material to be pickled takes place only slowly, mills are compelled to pickle the materials in a certain sequence one after the other. This sequential processing results in a delay in production creating additional very high storage costs. To increase the adaptation speed of the pickling bath activity to the material requirements, known plants adapt the pickling bath activity to the required operating conditions via temperature control. This results in a certain risk because the temperature control range is relatively narrow. Temperature changes of 30° C. are generally possible, causing the chemical reaction speed to be increased approximately eight times. Due to the great variety of stainless steel grades produced, however, metal abrasion rates may differ by a factor of up to 100. Easily pickled material qualities are therefore normally overpickled.

SUMMARY OF THE INVENTION

Therefore, it is the objective of the invention to provide a process for pickling of stainless steel for the entire range of types of stainless steel.

According to the invention, the acid concentration and/or composition is chosen as a function of the type or quality of the stainless steel material, the pre-treatment that the stainless steel material has been subjected to, and the operating parameters in the pickling plant. By choosing the acid concentration and/or acid composition, the operating range can be considerably extended over that currently possible by the temperature control.

An advancement of the invention is characterized by the fact that the acid dosing is achieved by feeding acid from storage tanks whose acid concentration and/or composition differ from each other. A suitable pickling bath can be obtained for any given stainless steel by controlled feeding of the acid from the various storage tanks.

An advantageous advancement of the invention is characterized by the fact that the pickling bath temperature is also controlled. By additionally controlling the pickling bath temperature, a pickling bath activity range and thus a suitable range of stainless steel qualities to be pickled can be achieved for any acid concentration and/or acid composition. If the temperature limit is reached, another acid from a different storage tank can simply be used.

An advantageous advancement of the invention is characterized by the fact that the flow rate of the acid feed is controlled. By suitable control of the flow rate of the acid feed a further adaptation of the pickling bath activity to the requirements is possible in a simple manner.

An advantageous design of the invention is characterized by the fact that operating parameters of the pre-treatment stages are controlled. This means that the current density of a pre-pickling stage involving electrolysis and/or the operating parameters at the blasting equipment, at the abrasive brushes, or a scale breaker can be adjusted. By controlling the operating parameters in the pre-treatment stages the required pickling bath activity can be reduced accordingly, and thus a suitable pickling effect can be achieved in the control range of the acid concentration, acid composition, pickling bath temperature and flow rate.

Another advantageous advancement of the invention is characterized by the fact that the acid concentration and/or acid composition is chosen from the respective tank and fed to the pickling bath as a function of the density of the waste pickle in the pickling bath. By metering the density of the waste pickle the formation of sludge can be determined and suitable controlled. Thus the formation of undesirable sludge is prevented in a simple manner.

An advantageous advancement of the invention is characterized by the fact that the acid concentration and/or acid composition is chosen from the respective tank and fed to the pickling bath as a function of the conductivity of the waste pickle. The conductivity of the waste pickle is a measure of the metal portion in the acid, whereby excessive sludge formation can also be prevented. The combination of density and the conductivity metering with a suitable control is particularly advantageous because although the density is primarily influenced by the metal content it also influenced by the nitric acid content. To compensate for the influence of the nitric acid content, it is advantageous to take into account the conductivity as well.

An advantageous advancement of the invention is characterized by the fact that the spent pickling acid is regenerated. To keep the operating costs low, the pickling acid can be routed to a suitable regeneration system.

An advantageous design of the invention is characterized by the fact that the regenerated waste pickle is mixed with fresh acid in accordance with its composition and fed back to the acid storage tanks. By suitable mixing with fresh acid, a constant level of acid concentration and/or acid composition can be maintained in the individual tanks.

The invention further concerns a plant for pickling material strips made of steel, in particular stainless steel, where the strip passes through at least one pickling bath containing at least one pickling acid, characterized by the fact that at least two circulation tanks with differing acid concentration and/or acid composition are provided. This design permits quick change of the acid concentration and/or acid composition and thus quick adaptation of the pickling effect to the requirements.

An advantageous advancement of the invention is characterized by the fact that the acid feed to the pickling bath is changed by switching from one circulation tank to another. This means that the regeneration system works at constant inlet concentrations and hence, constant initial conditions. Furthermore, errors in analysis and in manual acid dosing are avoided, therefore improving the product quality and efficiency of the plant.

An advantageous design of the plant according to the invention is characterized by the fact that at least two pickling baths with at least two circulation tanks each are provided. If the pickling plant comprises two stages, a greater range of variation of the pickling treatment can be achieved by filling the circulation tanks with acid of differing concentration and/or composition.

Additional advantages of the present invention include the provision of pumps with a flow rate control and heat exchangers in the circulation loop for controlling the rate of flow and temperature of the pickling acid. A control unit is provided which is connected to the valves of the acid feed lines, the temperature controls of the heat exchangers, the flow rate control of the circulation pumps and the corresponding control units for the operating parameters of the upstream units, whereby it is possible for the control unit to be connected to the densitometer. The control unit makes it possible to advantageously adapt the pickling efficiency of the plant to the material to be pickled as well as to any pre-treatment over a large variation range.

BRIEF DESCRIPTION OF THE DRAWING

The present invention may be better understood and its numerous objects and advantages will become apparent to those skilled in the art by reference to the accompanying drawing in which.

DETAILED DESCRIPTION OF THE PREFERRED EMBODIMENT

With reference to the drawings wherein like numerals represent like parts throughout the several figures, a pickling plant in accordance with the present invention is generally designated by the numeral 1.

Figure 1:
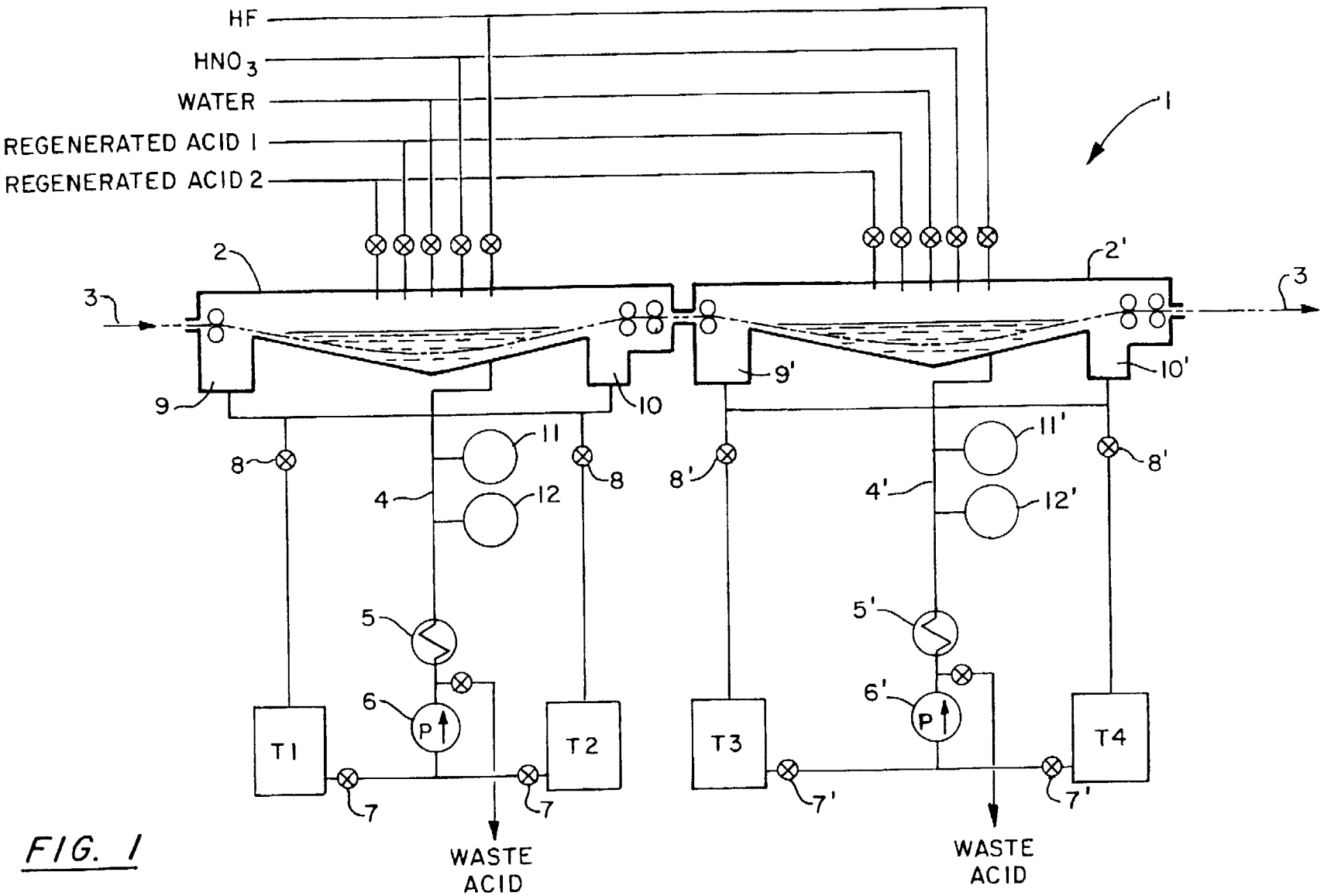
FIG. 1 is a schematic diagram of a pickling system in accordance with the present invention.

The pickling plant 1 shown in FIG. 1 comprises two pickling tanks 2, 2', through which the metal strip 3 is transported. Acid is fed via pipes 4, 4'. These feed pipes 4, 4' contain heat exchangers 5, 5' as well as circulation pumps 6, 6'. Feed acid is fed to the pickling tanks 2, 2' from the circulation tanks T1, T2, T3, T4 through valves 7, 7'. From the pickling tanks 2, 2' the waste acid is fed back to the circulation tanks at the beginning 9, 9' of the tank and at its end 10, 10' via valves 8, 8'. For filling the pickling tanks 2, 2' with pickling acid in the required concentration and/or composition, feed pipes for hydrofluoric acid (HF), nitric acid ($HNO_3$), water and various grades of regenerated pickling acid, varying in concentration and/or composition (Reg. Acid 1, Reg. Acid 2) are provided. The pipes can alternatively empty into the individual circulation tanks T1, T2, T3, T4. Pipes 4, 4' each contain a densitometer 11, 11' and a conductivity meter 12, 12' for control.

The individual circulation tanks T1, T2, T3, T4 are filled with acids of varying composition and/or concentration. Suitable feed acid is used for the first pickling tank 2, for example from the first circulation tank T1 for one material quality to be pickled. The pickling effect is adapted to the requirements by control of the flow rate of circulation pump 6 and/or the temperature by means of heat exchanger 5. If the pre-treatment or, for instance, the production speed of the metal strip, changes, the pickling effect can be suitably adapted by variation of the flow rate and/or the temperature. The same applies by analogy to pickling in pickling tank 2'.

If the quality (type of steel) of the metal strip to be pickled is changed, then a substantially changed pickling effect is required. This change can no longer be achieved by variation of the circulation flow rate and/or the temperature. According to the invention, a switch-over is effected and the feed acid from circulation tank T2 is used. Analogously, a switch-over can be effected for pickling tank 2' from circulation tank T3 to circulation tank T4. If only one pickling stage is to be operated with acid, it is possible for the second pickling tank 2' to be filled with water. To achieve even greater variability in relation to the pickling effect, acid from circulation tank T3 or T4 can be used in pickling tank 2. Analogously, acid from circulation tank T1 or T2 can be used in pickling tank 2'.

If the tanks are large enough, then acid from the same circulation tank T1, T2, T3 or T4 can be used in pickling tanks 2 and 2', and possibly, by adaptation of the flow rate of the circulation pumps 6, 6' or the heating of heat exchangers 5, 5', the pickling effect can be adjusted differently for the two pickling tanks 2, 2'. Also, a densitometer 11, 11' can be installed into the discharge of waste acid from pickling tanks 2, 2', for instance in the zone of discharge valves 8, 8', with which the density of the waste pickle and the quantity of sludge can be measured. A conductivity meter 12, 12' can also be installed to compensate the influence of the nitric acid content. Advantageously, all valves 7, 7', 8, 8', the temperature regulation of the heat exchangers 5, 5', the flow regulator of the circulation pumps 6, 6', the densitometers 11, 11' as well as the conductivity meters 12, 12', valves for acid feed pipes and suitable control parameters of the pre-treatment stage, are connected to a control unit which controls the pickling effect on account of the entry of material-related parameters.

In one embodiment, the waste acid is regenerated in a regeneration system known in the art. The regenerated waste acid is mixed with fresh acid in accordance with its composition and fed back to the acid storage tanks. By suitable mixing with fresh acid, a constant level of acid concentration and/or acid composition can be maintained in the individual tanks.

It should be appreciated that the acid concentration and/or acid composition may also be chosen as a function of the operating parameters of the pickling bath. Such operating parameters may include the pickling bath temperature, the concentration of the pickling acid, and the speed of the steel strip as it passes through the pickling bath.

Figure 2:
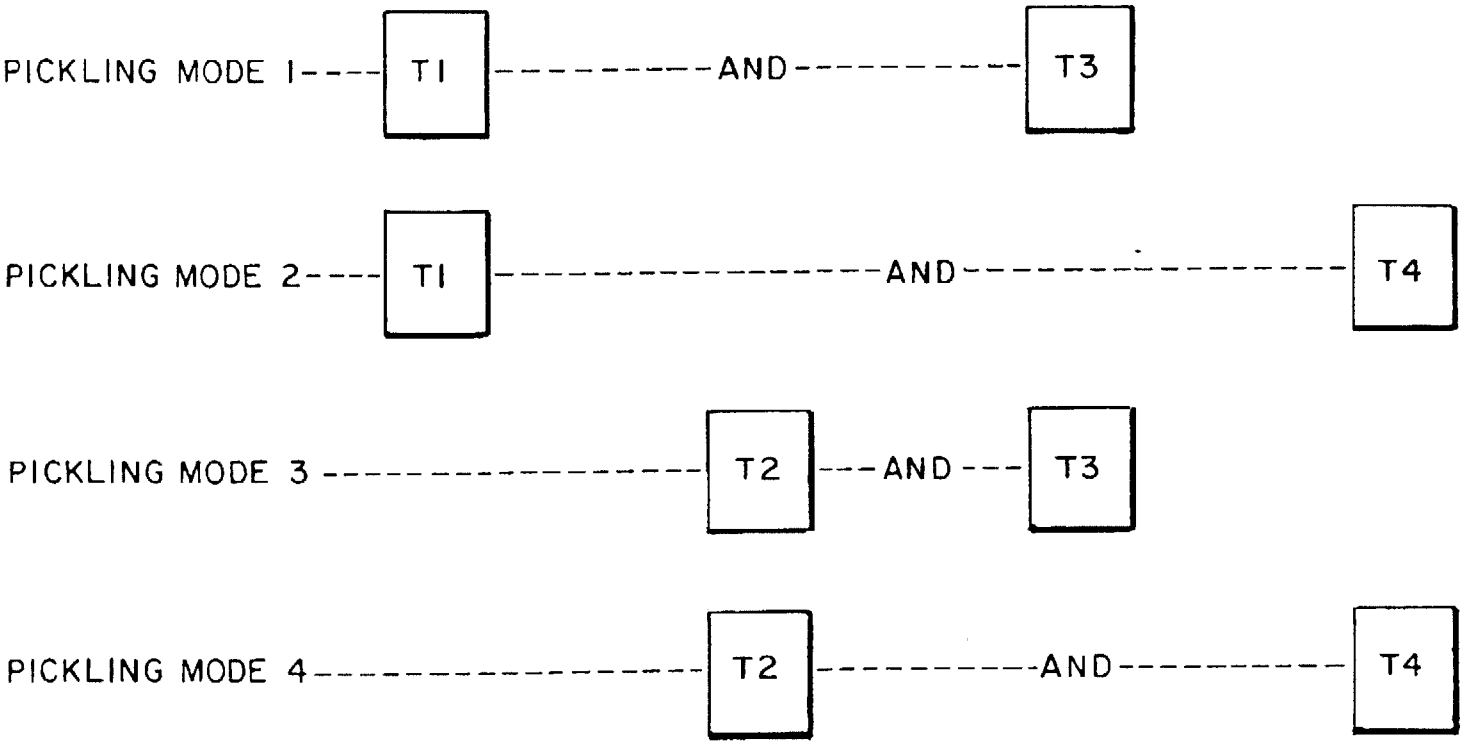
FIG. 2 is a schematic diagram of the various switching options of the pickling system of FIG. 1.

The various operating modes and corresponding use of the acids in the individual circulation tanks are presented in FIG. 2. As explained above, the first and second pickling tanks 2, 2' may receive acid from circulation tanks T1 and T3 (Mode 1), T1 and T4 (Mode 2), T2 and T3 (Mode 3), or T2 and T4 (Mode 4), respectively.

What is claimed is:

1. Process for pickling material strips made of stainless steel, the stainless steel having a material quality and being subjected to pre-treatment prior to pickling, the process comprising the steps of:

selecting a mixed acid composed of a combination of hydrofluoric acid and nitric acid, the combination affecting a composition and a concentration of the mixed acid;

placing a quantity of the mixed acid in at least one pickling path to form a pickling bath; and passing the strip through the pickling path, wherein the composition and concentration of the mixed acid in the pickling bath is selected and automatically, continuously controlled as a function of the material quality, operating parameters of the pickling bath, and the operating parameters of the pre-treatment of the strip.

2. Process according to claim 1, further comprising the steps of feeding the selected acid from one of a plurality of storage tanks to establish a flow of feed acid, each of the storage tanks containing a feed acid having a different concentration and composition than the feed acid stored in the other storage tanks.

3. Process according to claim 2, further comprising the step of returning acid to the one storage tank to establish a flow of waste acid.

4. Process according to claim 3, further comprising the step of measuring the density of the flow of waste acid wherein the concentration and composition of the selected feed acid is a function of the density of the waste acid.

5. Process according to claim 3, further comprising the step of measuring the conductivity of the flow of waste acid wherein the concentration and composition of the selected acid is a function of the conductivity of the waste acid.

6. Process according to claim 3, further comprising the step of regenerating the waste acid to produce regenerated acid.

7. Process according to claim 6, further comprising the steps of mixing the regenerated acid with new acid in accordance with the composition of the regenerated acid to produce feed acid and recycling the feed acid to the appropriate acid storage tank.

8. Process according to claim 2, wherein the feed acid flows at a rate, the process further comprising the step of controlling the flow rate of the feed acid.

9. Process according to claim 1, further comprising the step of controlling the pre-treatment of the strip.

10. Process according to claim 9, wherein the pre-treatment comprises pre-pickling the strip by electrolysis, the process further comprising the step of controlling the current density during electrolysis.

11. Process according to claim 9, wherein the pre-treatment comprises treatment selected from the group consisting of blasting, abrasive brushing and scale breaking, the process further comprising the step of controlling the operating parameters during the pre-treatment.

12. Process according to claim 1, wherein the strip of stainless steel is transported through the pickling path at a strip speed and the composition and concentration of the acid is selected and automatically, continuously controlled as a function of the strip speed.

13. Process for pickling material strips made of stainless steel, the stainless steel having a material quality and being subjected to pre-treatment prior to pickling, the process comprising the steps of:

selecting a mixed acid composed of a combination of hydrofluoric acid and nitric acid, the combination affecting a composition and a concentration of the mixed acid, the composition being selected and automatically, continuously controlled as a function of the material quality, operating parameters of the pickling bath, and the operating parameters of the pretreatment of the strip;

placing a quantity of the mixed acid in at least one pickling path to form a pickling bath; and passing the strip through the pickling path.

14. Process for pickling material strips made of stainless steel, the stainless steel having a material quality and being subjected to pre-treatment prior to pickling, the process comprising the steps of:

selecting a mixed acid composed of a combination of hydrofluoric acid and nitric acid, the combination affecting a composition and a concentration of the mix acid, the concentration being selected and automatically, continuously controlled as a function of the material quality, operating parameters of the pickling bath, and the operating parameters of the pretreatment of the strip;

placing a quantity of the mixed acid in at least one pickling path to form a pickling bath; and passing the strip through the pickling path.

15. A plant for pickling material strips made of stainless steel, comprising:

pickling bath means for bathing the steel strips in a quantity of pickling acid contained therein, the pickling acid having a combination of feed acids, the combination defining a composition and a concentration of the pickling acid;

circulation tank means for storing the feed acid, selectively feeding the feed acid to the pickling bath means, and receiving a waste acid from the pickling bath means, the circulation tank means comprising a plurality of circulation tanks in fluid communication with the pickling bath means, each of the circulation tanks containing a feed acid having a composition and concentration that is different from the composition and concentration of the feed acid contained in each other circulation tank, one of the circulation tanks storing a feed acid composed of hydrofluoric acid and another of the circulation tanks storing a feed acid composed of nitric acid; and control means disposed intermediate the circulation tank means and the pickling bath means for controlling the composition and concentration of the pickling acid by selectively feeding feed acid from one of the circulation tanks or another of the circulation tanks.

16. Plant according to claim 15, further comprising density measuring means for measuring the density of the waste acid.

17. Plant according to claim 15, wherein the pickling bath means comprises at least two pickling baths.

18. Plant according to claim 15, further comprising heat exchanger means for controlling the temperature of the pickling acid.

19. Plant according to claim 15, further comprising pump means for pumping feed acid from the circulation tank means to the pickling bath means.

20. Plant according to claim 15 further comprising heat exchanger means for controlling the temperature of the pickling acid, pump means for pumping feed acid from the circulation tank means to the pickling bath means, circulation path means for providing fluid communication between the pickling bath means and the circulation tank mean, valve means disposed in the circulation path means for selectively opening and closing the circulation path means and control means for controlling the pickling, the control means being in communication with the heat exchanger means, the pump means and the valve means.

21. Plant according to claim 20, further comprising pre-treatment means for pre-treating the strip prior to pickling the strip, wherein the control means is in communication with the pre-treatment means.

22. Plant according to claim 21, further comprising density measuring means for measuring the density of the waste acid, wherein the control means is in communication with the density measuring means.

* * * * *